United States Patent [19]

Ruffer et al.

[11] 4,228,625

[45] Oct. 21, 1980

[54] CONSTRUCTION SYSTEM

[76] Inventors: Dittmar Ruffer, Danziger Strasse 47; Edmund Wagner, Beethovenstrasse 10, both of D-6200 Wiesbaden, Fed. Rep. of Germany

[21] Appl. No.: 971,017

[22] Filed: Dec. 19, 1978

[30] Foreign Application Priority Data

Feb. 13, 1978 [GB] United Kingdom ..... 90/78

[51] Int. Cl.[3] ..... E04C 2/06

[52] U.S. Cl. ..... 52/223 R; 52/405; 52/584; 52/600

[58] Field of Search ..... 52/601, 600, 723, 561, 52/223 R, 86, 405, 584

[56] References Cited

U.S. PATENT DOCUMENTS

| | | | |
|---|---|---|---|
| 2,497,887 | 2/1950 | Hilpert | 52/601 |
| 2,703,003 | 3/1955 | Ruppel | 52/601 |
| 4,164,831 | 8/1979 | Messick | 52/601 |

*Primary Examiner*—John E. Murtagh
*Attorney, Agent, or Firm*—Kurt Kelman

[57] ABSTRACT

A construction system comprises a lattice girder reinforcement and a formwork for producing double-skinned concrete ceiling or wall slabs, with two frames separated from each other. The rising reinforcement of the inner skin is bent towards the outer skin so that the top inner skin support edge remains undisturbed and extends to the top outer skin edge. It comprises a reinforced haunched concrete slab each end of which defines a slot through which an interconnecting tie bar extends. Abutting prefabricated slabs are aligned with respective connecting bars inserted into slots and joints between two abutting wall elements. A board with an open hole is slid on the rear end of the connecting bar and bears on the other surface of the wall elements and a turnbuckle at this end bears on the free surface of the board. For thermal insulation of the joints, thermal insulating mats adjacent thereto are so profiled as to produce a continuous space in the longitudinal direction of the joints, the profile of the outside of the space being broader than the inside. A thermally insulating bar with the same profile as the space is inserted therein.

22 Claims, 38 Drawing Figures

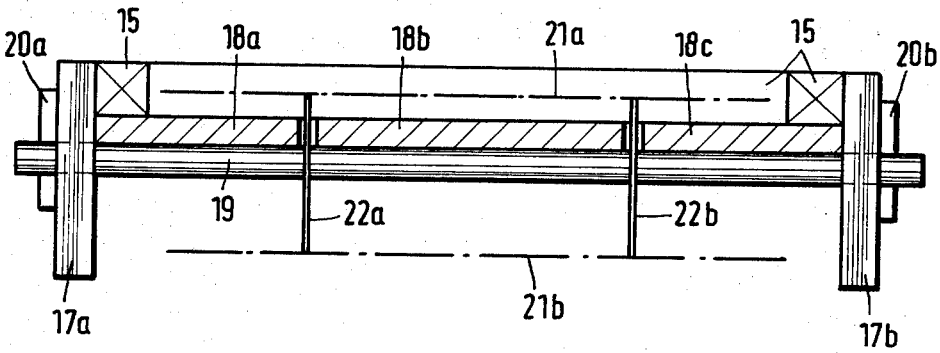
Fig.10
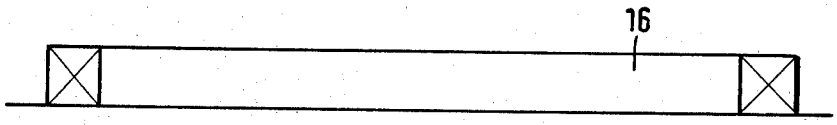
Fig.11
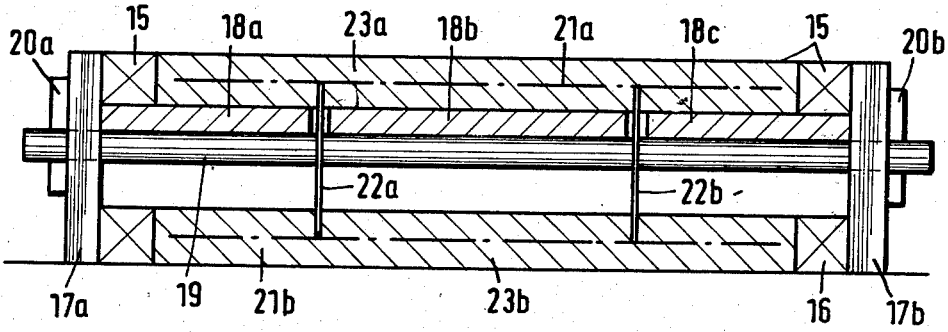
Fig.12
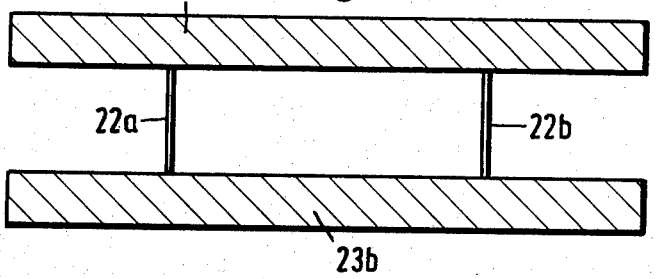

CONSTRUCTION SYSTEM

The invention relates to a construction system comprising a series of devices and reinforcements and intended to combine manufacture in the concrete works and installation on site.

The invention initially relates to reinforcement for a wholly or partially prefabricated ferroconcrete wall or slab containing at least one reinforcement mat the longitudinal bars of which are partially surrounded by the bent diagonal struts of the girder member at least the bottom flange of which bears on the transversely orientated mats.

The invention also relates to a two-part formwork for producing double-skinned concrete components, so-called double concrete slabs, more particularly of reinforced concrete, usually ceiling or wall slabs comprising two concrete skins situated parallel with each other or not parallel with each other at a distance from each other and connected to each other by means of the reinforcement or in some other manner, in which the green concrete for the bottom concrete skin is dumped into the bottom formwork frame and the green concrete is vibrated and distributed where appropriate after which the bottom formwork frame together with the prefabricated reinforcement is lowered from above, bears on the bottom part of base by means of spacers and the reinforcement penetrates into the green concrete of the bottom concrete skin. The green concrete for the top concrete skin is poured and vibrated thereafter or prior thereto.

The invention also relates to a double-skinned reinforced concrete slab for use as a vertical building wall exposed to bending stress, namely as an external wall exposed to soil pressure in which the inner skin is shorter than the outer skin and serves to form a bearer for a horizontal ceiling slab and the reinforcement comprises steel mats disposed in both skins and girder members which interconnect the mats, and the rising reinforcement of the inner skin projects above the top end-face edge thereof approximately to the height of the top edge of the outer skin. The invention also relates to a reinforced, bent pre-cast concrete slab.

The invention also relates to apparatus for aligning abutting prefabricated constructions slabs with a transverse bar on one of whose ends there is mounted an internal longitudinal bar which bears upon the surfaces of two of the construction slabs and whose other end is provided with a longitudinal slot into which a wedge is driven approximately parallel with the internal longitudinal bar and bears on the other surfaces of the construction slab and thus aligns them.

The invention also relates to a device for aligning prefabricated slab-shaped wall elements. Cavity walls, solid walls and wall panels of all kinds of material can be considered as such wall elements. Additional steps in the form of retaining means to prevent horizontal displacement are necessary for the installation of prefabricated part-walls, depending on the state of construction.

The invention also relates to apparatus for the thermal insulation of joints between abutting doubleskinned concrete construction slabs and in which a thermal insulating mat bears upon the inside of one of the concrete skins.

Known reinforcements permit only a one-sided connection between mat and girder and the girder is connected to the other mat be means of wire or other aids which call for excessive manual labor and for this reason reinforcements of the initially mentioned kind have already been proposed in which the girder parts are positively connected to the two reinforcement mats without any additional aids. The components which interconnect the mats in this case comprise intersecting diagonal struts but this does not provide a fully satisfactory solution for many kinds of wall construction and also calls for a somewhat more complicated manufacturing procedure.

Part-prefabricated double-concrete slabs of the kind described hereinbefore are used as ceiling slabs or as wall slabs in buildings erected above or below ground and the space between the two concrete skins in the region of the reinforcement can also be cast in with concrete to function as a rib. This construction will then result in so-called hollow rib ceilings or hollow rib walls. Wall slabs of the construction described hereinabove are usually employed as partially prefabricated wall slabs, i.e. the space between the two concrete skins can be filled at the building site with on-site concrete.

Partially prefabricated double-skin concrete slabs of this kind are normally produced by means of turn-over and hinging devices which are so arranged that, after one concrete skin has set on one pallet of the device, the skin is guided in hinged manner over the second, freshly cast concrete skin on the other pallet of the device and the reinforcement, already introduced into the first concrete skin and projecting therefrom, penetrates into the green concrete of the second concrete skin and is anchored therein when the concrete sets. This turn-over operation is performed differently with hoists disposed on pivotable tackle or with hinged pallets which are hydraulically or otherwise actuated. In all these procedures it is a disadvantage that time must elapse to allow for setting of the top concrete skin before this is turned over. Another disadvantage is due to the fact that, during and after passing through the top dead-center in the course of the hinging or turning operation, personnel nearby are exposed to substantial risks due to dropping of the concrete skin which is possibly not completely set or has been inexpertly secured. It is essential to ensure that the top concrete skin is lowered upon the bottom concrete skin with an accurate fit. Finally, the known manufacturing devices are comparatively complex and costly because of the lifting and turn-over devices for which they call.

The German Offenlegungsschrift No. 2,111,485 also discloses a method which attempts to eliminate the above-mentioned disadvantages by both concrete skins being produced one above the other, in decks, within edge formwork that surrounds both concrete skins. However, introducing the reinforcement and striking the formwork for the top concrete skin is very costly and complex and this also applies to the corresponding stripping operation due to removal being rendered more difficult.

Prefabricated cavity walls of the kind described hereinbefore are conveyed to the building site in the form of transportable precast elements and are placed at the building site by means of hoists. The cavity of such walls is subsequently filled with concrete.

To absorb the forces which act on the cavity walls until they are filled with concrete the thin outer skins of such walls, which can be regarded as a formwork substitute, are provided with steel reinforcement. Such steel reinforcement can be utilized in external walls which are stressed by soil pressure or other horizontal forces. Generally this also applies to internal walls to the extent to which these must withstand a horizontal bending stress. This bending stress is absorbed in the form of so-called internal forces within the filled cavity wall due to compressive forces which act in the concrete and tensile bending forces which act in the reinforcement.

To support horizontal components such as floors and ceilings the inner skin of the precast component is constructed to the height of the bottom edge of the ceiling in the manufacture of the precast components but the outer precast skin is extended to the top edge of the ceiling.

As a consequence the internally disposed reinforcement extends only as far as the bottom edge of the ceiling and cannot therefore be provided with the end anchoring means within the ceiling.

Accordingly, additional steelwork is placed into the cavity on site. This is very costly.

A double-skinned, reinforced concrete slab of the kind described hereinbefore is disclosed by the German Gebrauchsmusterschrift (utility model) No. 1,928,697. The rising reinforcement of the inner skin continues rectilinearly in that slab to the top edge of the outer skin. The partially prefabricated walls thus produced are bridged with a conventional ceiling the concrete of which is poured on site on suitable formwork.

If the above-described partially prefabricated wall slab is to be used in conjunction with a likewise partially prefabricated ceiling slab, difficulties will occur since the top edge of the inner skin is interrupted by the reinforcement which extends linearly therethrough so that insufficient space remains as support for the partially prefabricated ceiling slab. If the rising reinforcement of the inner skin is cut off at the top edge of the inner skin so that the full top edge thereof is available as support, it would be necessary to take separate steps to take up the principal stresses in the transition region between the wall and the ceiling, for example by the insertion in suitable manner of secondary reinforcement.

This in turn is labor-intensive and contradicts the idea of the most extensive possible prefabrication of the wall and ceiling elements of a building structure.

An inclined concrete slab of the kind described, also known as an inclined haunched slab is disclosed by the German Offenlegungsschrift No. 2,611,611.

A device for the alignment of abutting prefabricated slabs is disclosed in Austrian Pat. No. 296,562. To facilitate the alignment of the slabs associated with a suspended ceiling, the circumference of the slabs is provided with a plurality of recesses which are spaced from each other and into which is inserted a device with the previously-mentioned features. The inner longitudinal bar in this case is welded to the transverse bar. However, this involves the disadvantage that manufacturing tolerances in the thickness of abutting slabs result in the slab surfaces which bear upon the inner longitudinal bar being brought into alignment in one plane due to the previously-mentioned rigid connection between the inner longitudinal bar and the transverse bar, while the other surfaces of the two slabs at the wedge do not present a smooth external surface if the above-mentioned tolerances occur. Moreover, providing the previously-mentioned openings into which the alignment devices are inserted also represents additional labor.

Previous methods for the alignment of prefabricated slab-shaped wall elements are confined to the attachment on both sides of timber beams which must be separately secured to prevent slipping. Inclined strutting, which must also be reliably retained against horizontal displacement at the bottom fixing, is then attached to the said timber beams.

Other procedures make use of screwed connections which are partially recessed into the walls or are additionally attached thereto.

In the absence of a ferroconcrete connection at the base of the wall, the spatial stability of such walls can be produced only if permanent retaining means against horizontal forces are provided at the top of the wall in the form of peripheral tie beams or floor sheets.

It is difficult to produce a flat wall surface comprising a plurality of individual components if prefabricated components are installed. This applies both to the horizontal direction and to the vertical direction.

Components which are placed side by side in the horizontal and vertical direction (in terms of stories) must often be placed with an accurate fit side by side or one above the other to ensure reliable transmission of forces and the necessary stability of the building structure.

Heat or cold insulation for prefabricated components was hitherto obtained either by the suspension in front of the facade of separate prefabricated components the surface of which contained thermal insulation or insulating mats were adhesively fixed to the facade surfaces or otherwise attached thereto and a facade finish was applied thereabove.

It was difficult to bridge the joints of prefabricated components so as to ensure an equivalent thermal insulation. One reason for the difficulty was the need for absorbing the manufacturing tolerances.

It is the object of the invention in reinforcement of the initially-described kind to produce the girder parts by the use of simple materials and to connect them to the reinforcement mats with only a few manipulations. All parts of the reinforcement are to be space-saving, suitable for nesting and transportation and the reinforcement as such must be able to withstand the applied formwork pressure without the aid of additional means. When used in ceilings, the reinforcement must also be able to withstand loads due to the assembling procedure.

The invention avoids the disadvantages inherent in the manufacture of partially prefabricated double-skinned concrete slabs. It is the object of the invention to propose shuttering by means of which concrete slabs of the above-described kind can be rapidly and inexpensively produced with accurate dimensions, identical contours and plane parallel to the extent to which this is desired, and the operations of placement into the formwork and stripping therefrom are greatly facilitated.

The invention also avoids the disadvantages regarding the forces which act, particularly in the case of horizontal loading (soil pressure). It is the object of the invention to propose a double-skinned reinforced concrete slab of the above-described kind which is able to absorb the previously-described principal tensile stresses without additional expenditure and in accordance with the relevant standards at the same time permitting the use of a reinforced ceiling slab as a partially prefabricated ceiling.

It is also the object of the invention to propose a reinforced inclined haunched concrete slab of the kind already described to permit a particularly efficient assembling operation to be performed.

The invention also avoids the disadvantages which occur in the alignment of slabs. It is the object of the invention to disclose apparatus by means of which abutting prefabricated slabs, more particularly double-skinned wall slabs, can be aligned with simple means on the external surfaces on which the wedge is driven into its slot.

It is also the object of the invention to propose means for the alignment of prefabricated slab-shaped wall elements by means of which the construction can be assembled efficiently without time-consuming procedures. The method should also be suitable for absorbing conventional tolerances.

It is also the object of the invention to propose apparatus by means of which the joints between abutting slabs can be effectively thermally insulated.

One solution regarding the reinforcement was found by the provision of a lattice girder with only one top flange bar and one bottom flange bar and at least one of the bars is supported by a strut which is disposed transversely to the plane of the flange and extends to a longitudinal bar of the mat. The top flange bar or the bottom flange bar can of course also comprise double bars or the like. To this end it is particularly advantageous to construct the supporting strut in the form of a retaining clip one end of which surrounds the girder flange as well as the longitudinal reinforcement bar associated therewith and with the other end partially surrounding the longitudinal bar of the other mat. Alternatively, the supporting strut or the retaining clip can be constructed as part of the girder diagonals and the end thereof which surrounds the flange bar can be welded thereto. The last-mentioned case practically refers to a spatial lattice girder with diagonal binders in which only one member of each binder is provided with a bottom flange. The binders themselves comprise separate parts, namely the diagonals and the retaining clips.

To solve the problem in terms of manufacture, the invention is characterized in that the green concrete for the bottom concrete skin is placed into a bottom formwork frame and thereafter the top formwork frame, into which the reinforcement and the horizontal formwork surfaces have already been inserted, is guided over the bottom formwork frame and is inserted into suitable adjusting means and the reinforcement is lowered into the green concrete of the bottom concrete skin and finally the green concrete of the top concrete skin can be applied unless this has already been done previously, whereupon the formwork surfaces can be laterally withdrawn after both concrete skins have simultaneously set and the finished double-skinned concrete slab is stripped by lifting out the top formwork frame and subsequently or simultaneously the bottom formwork frame.

Proceeding from a concete slab of the kind described hereinbefore, the forces can be absorbed in accordance with the invention by virtue of the rising reinforcement of the inner skin being bent towards the outer skin in the region of the horizntal top support edge of the inner skin so that the support edge remains substantially undisturbed and approximately as far as the top edge of the outer skin.

To solve the problem of a reinforced haunched concrete slab, the invention is characterized in that each of the ends of the concrete slab is provided with a slot through which extends a tie bar adapted to connect both ends and whose own ends are anchored in the slab by means of an L-section one of whose members bears on the top of the slab, and the tie bar is connected to the other member of the section which bears on the end edge of the slab.

Proceeding from a device for aligning abutting prefabricated slabs of the kind described hereinbefore, alignment in accordance with the invention is achieved by virtue of the inner longitudinal bar being inserted into a longitudinal slot of the transverse bar.

The invention for solving the problem of alignment is also characterized by the insertion into a joint between two abutting wall elements of a connecting bar to whose front end there is welded a transversely extending retaining bar which bears on one of the surfaces of the wall elements, by an open bore in a board through which this can be slid on the rear end of the connecting bar to bear on the other surface of the wall elements and that a turn-buckle which bears on the free surface of the board is slid on the rear end of the connecting bar.

Proceeding from a device of the previously-mentioned kind for thermally insulating the joints between abutting slabs, this is achieved in accordance with the invention by profiling of the thermal insulation mat edges adjoining the relevant joint so as to produce a space which is contiguous in the longitudinal direction of the joint and whose profile on the outside is broader than on the inside and that a bar of thermally insulating material, with a profile approximately corresponding to the profile of the space, is inserted therein.

The previously-mentioned novel reinforcement girder member can also be used, as already indicated, for ferroconcrete walls and for large-surface slabs.

When used for walls the reinforcement will contain two reinforcement steel mats situated at a distance from each other and between which the girder member is disposed and the bottom flange as well as the top flange bears on the transversely situated struts of the corresponding mats.

When used for large-surface slabs, two diagonal struts which meet in the top flange can be combined in a binder. The retaining clip in this case performs the function of stiffening the girder member in the horizontal plane. The retaining clip stabilizes the girder member while the overall reinforcement element is being produced and, after setting of the concreted wall skins, it prevents mutual displacement thereof during transportation and installation.

The components of the novel reinforcement have excellent nesting capabilities.

The production of double-skinned wall elements of the kind described hereinbefore obviates the need for the otherwise necessary additional operation of turning and folding over of the top skin to the bottom skin with the previously-described disadvantages, because according to the invention and with the aid of two formwork frames arranged parallel with each other, the concrete can be placed almost simultaneously in the final position of the concrete skin so that it is no longer necessary to move the freshly filled concrete skins before they set together. The difficult and complicated placing of reinforcement and formwork surfaces as well as the removal of these parts from the double-skinned concrete slab is also obviated because of the two-part construction according to the invention of the entire formwork.

It has been found a considerable advantage that chamferings required for installation on site or circumferential grooves on or near the side surfaces of the two concrete skins can be cast-in by appropriate shaping of the formwork frames, a feature which in turn facilitates stripping of the finished double-skinned concrete slab from both formwork frames. It is also possible to attach suitable sectional bars to the formwork frames in such a way as to produce grooves or chamferings in the edge region on the inside of the double-skinned wall components.

Hollow rib ceilings and walls can also be produced with the formwork according to the invention. To this end lateral members are introduced into the formwork between the two concrete skins and between which a concrete rib is formed by monolithic bonding when the green concrete is poured for the top concrete skin. It is recommended that such a rib be situated in the region of the connecting reinforcement disposed between the two concrete skins.

By using the formwork according to the invention it is also possible to cast any desired recesses into the concrete skins by using conventional secondary formwork.

The above-mentioned steps of arranging the reinforcement enable the full width of the inner skin of the concrete slab to be used as a support edge for ceiling slabs because the top edge of the inner skin remains undisturbed. The principal tensile stresses in the region of the transition between the wall and the ceiling are absorbed in optimum manner by the above-mentioned inclined haunching of the rising reinforcement. Furthermore, an adequate length for anchoring the reinforcement is available above the zero line because the reinforcement extends approximately to the top edge of the outer skin. Producing such a concrete slab does not present any difficulties because the rising reinforcement of the inner skin penetrates therethrough at the place at which there is a formwork joint in conventionally produced skins. The installation reinforcement which is in any case provided in such hollow slabs is thus fully utilized for absorbing the principal tensile stresses.

Due to the steps taken with regard to the haunched concrete slab the ends thereof are interconnected in the transverse direction to the haunching line of the slab by means of one or more tie bars which extend parallel with each other. Supports which are normally required to extend over the length of the slabs are thus obviated when the slab is installed. Instead it is sufficient to support the slab only at its ends.

The forces acting on the slab ends via the tie bar are absorbed by virtue of the L-section bearing by means of its members on the above-described edges of the slab.

It is recommended that the profile member is provided with a slot which extends from the free edge of the member that bears on the top of the slab approximately to the height of the tie bar. This permits a simple connection to be established between the tie bar and the profile member by means of anchoring and the free end of the tie bar.

The tie bar can be of variable length to permit adjustment of the forces that are to be absorbed by it.

To produce the haunched concrete slab the top flange bars of the trussed girder associated with the reinforcement of the slab are cut at the haunching place of the slab. This procedure is disclosed in the above-mentioned German Offenlegungsschrift. The fact that the free ends of the top flange bars are welded to each other is regarded as an important embodiment of the slab. A novel manufacturing process for such a reinforced haunched concrete slab is thus made possible, more particularly in the manufacturer's works, namely by virtue of the slab being poured in a flat mold together with its reinforcement in a conventional manner on a flat base. After the concrete has set, the top flange bars which extend parallel with each other and are associated with the trussed girder are cut at the above-mentioned place in known manner. The main part of the slab is then raised and placed on supports to obtain the desired haunching. With the slab in the haunched shape the free ends of the top flange bars are welded to each other to produce a slab which has the necessary bending stiffness for installation.

In principle there are two possibilities. One is characterized in that a secondary bar interconnects the free ends of the top flange bars. With the other possibility an existing top flange bar of one of the existing trussed girders, which projects beyond the cutting place from one side, is haunched and its free end is welded to another existing part of the trussed girder.

In the apparatus for aligning abutting prefabricated slabs a hinge connection replaces the above-mentioned welded connection between the two bars at the stated place. This enables the above-mentioned thickness differences of abutting slabs to be absorbed by the hinge connection by virtue of the inner longitudinal bar setting itself transversely in accordance with the thickness difference. The described apparatus can be employed particularly readily for aligning double-skinned wall slabs of the above-mentioned kind in which the inner longitudinal bar is no longer readily accessible. The double-skinned wall slabs are then aligned so that their outsides are flush, thus dispensing with the need for plastering.

In the other device for aligning prefabricated slab-shaped wall elements, the above-mentioned step combined with the production of the prefabricated component at the manufacturer's works combines the advantage of efficient assembly so that low-cost components can be produced.

To ensure horizontal retention of the entire wall, it is advantageous to provide variable-length haunched supports one side of which is connected to a ceiling of the building structure and the other side being connected to the connecting bar. Suitable adjustment of the length of the haunched supports, which are provided at a distance from each other on some of the connecting bars, enables an entire wall, comprising a plurality of slab-shaped wall elements, to be perpendicularly aligned.

There are several possibilities for aligning the wall bases. One possibility is characterized in that angle frames are provided as re-usable molds for concreting the wall bases. Dimensional tolerances in the ceiling, which can of course also be a prefabricated component, are thus equalized in a simple manner.

Another embodiment is characterized by the provision of floor bricks which serve as wall base. These floor bricks are then laid into a mortar bed by means of which the tolerances can be equalized. The use of floor bricks offers the advantage that the load-bearing wall cross-section of the wall panel placed upon the floor bricks is substantially utilized in terms of its load-bearing capacity.

To this end it is advantageous if the middle of the floor brick over a baseplate, the width of which corresponds to the thickness of the wall slab, has a protuberance the flanks of which converge in an upwardly extending taper. This ensures centralized placement of the wall slabs on the floor bricks.

It is also advantageous if concreting pockets are formed at distances from each other on the sides of the protuberance. The purpose of the concreting pockets is to provide a monolithic join between the relevant wall slab and the floor bricks.

The above-mentioned profiling of the space and of the bar of thermally insulating material ensures reliable retention of the bar in the space for the purpose of thermal insulation because the bar is retained towards the outside by the outer concrete skin. After attaching the appropriately profiled thermal insulating mats, it is therefore merely necessary to insert a bar into each space which then provides thermal insulating bridging between abutting concrete slabs. This procedure can be performed at the manufacturing works or on the building site, more particularly prior to green concrete being poured into the space between the two concrete skins.

Particularly good insulating values are obtained if the bar is of T-section. This section also ensures good retention of the bar because of the two shoulders of the T-section.

It is also advantageous if the thickness of the bar shoulder formed by the T-section is slightly smaller than the thickness of the corresponding part of the reception space. This step compensates for any penetration of the concrete within the thickness of the thermally insulating mats when green concrete is poured during the production of the prefabricated component. The proposed steps ensure that the heat and cold insulation at critical joints is the same as that on the remaining surfaces of the external elements. This becomes more important as the size of the prefabricated components diminishes, i.e. with an increasing number of joints on the external wall.

The invention, is illustrated in the accompanying drawings, in which:

FIG. 1 is a side view of the girder part of a reinforcement,

FIG. 2 is a section through the novel reinforcement using the girder parts according to FIG. 1, FIG. 3 is a section of a slightly modified reinforcement, FIG. 4 is a side view of the girder part for use with large-surface slabs, FIG. 5 shows a complete formwork, FIG. 6 shows the top formwork frame and the spacer feet thereof, FIG. 7 shows the timber formwork surfaces thereof, FIG. 8 shows one of the retaining tubes with the lateral retaining lugs of the formwork, FIG. 9 shows the bottom formwork frame thereof, FIG. 10 shows the formwork of FIG. 5, with top and bottom reinforcements, FIG. 11 shows the entire formwork system, FIG. 12 shows a finished double-skinned concrete slab, FIG. 13 shows another formwork embodiment, FIG. 14 shows a modification thereof, FIG. 15 shows yet another formwork embodiment, FIG. 16 shows a bottom formwork with a formwork panel, FIG. 17 is a perspective view of a formwork according to the invention, FIG. 18 shows diagrammatically a double-skinned concrete slab according to the invention, FIG. 19 is a diagrammatic side view of a slab with haunched ends according to the invention, FIG. 20 is a plan view of FIG. 19, FIG. 21 is an enlarged view of detail X of FIG. 19, FIG. 22 is a view of the retaining bracket shown in FIG. 21, FIG. 23 shows the left-hand end of FIG. 19 to explain further details, FIG. 24 is a side elevational view, partly in section, of a device for aligning abutting prefabricated slabs, FIG. 24 is a side elevational view, partly in section, of a device for aligning abutting prefabricated slabs, FIG. 25 is a section along line II—II of FIG. 22, FIG. 26 illustrates the principle of installing the aligning device, FIG. 27 is a side view of the device of FIG. 26, FIG. 28 is a plan view thereof, partly in section, FIG. 29 illustrates a wall top with a haunched support using the device of FIGS. 26 to 28, FIG. 30 shows a wall base of an external wall in elevation and partly in section, FIG. 31 is a similar view without the base system according to FIG. 30 on an internal wall, FIG. 32 is a side elevational view of a base block, FIG. 33 is a plan view of FIG. 32, FIG. 34 is a section along line IX—IX of FIG. 35, FIG. 35 is a plan view of part of an angle frame, FIG. 36 is a horizontal section through an external wall of a building at two abutting double-skinned concrete slabs with a device for the thermal insulation of the joint, FIG. 37 is an enlarged view of a preferred embodiment of an insulating bar used in the thermal insulation device, and FIG. 38 is a like view of another embodiment of the insulating bar.

Referring now to the drawing and first to FIG. 1, the reinforcement described as an example and intended for a ferroconcrete wall comprises surface trussed girders which are provided with a top flange bar 1 of slightly larger diameter and a bottom flange bar 2 of slightly smaller diameter, both being connected to each other by means of diagonal struts 3. The supporting strut or retaining clip 11, shown in projection and described subsequently, can be recongnized between the girder parts. Depending on their application and function the dimensions of the top flange and bottom flange can be different or identical.

As can be seen by reference to FIG. 2 the top end of the struts have a straight sharp bend 5 at an obtuse angle and an approximately hook-shaped curved portion 6 at the bottom end. The top and bottom flange 1,2 is mounted on the side of the diagonals 3 which faces away from the bent portions. In the complete reinforcement system illustrated in FIG. 2 the top bent portion 5 extends over an inwardly oriented longitudinal bar 7 of a top reinforcement mat 8*a* and its bottom hook-shaped end also extends around an inwardly oriented longitudinal bar 7 of a second reinforcement mat 8*b*.

As indicated in FIG. 2 it is convenient to arrange the above-described girder parts in mirror-image configuration. Since the bottom flange 2 of the girder part bears on the cross-bar 9 of the bottom reinforcement mat 8*b*, the girder will be secured in the direction of the arrow 10 and, in the opposite direction, it is retained by the strut 11 the top hook-shaped part 12 of which surrounds both the longitudinal bar 7 and the top flange 1. Strut 11 extends downwardly at an angle and with its bottom hook-shaped end 13 surrounds a second longitudinal bar 7*a* which is associated with the bottom mat 8*b* and is situated at a distance from the girder part.

Reinforcement mats 8a and 8b in which the longitudinal bars 7 are disposed on the outside of the transverse bars 9, are used in the example illustrated in FIG. 3.

By being placed at an angle on the transverse bars with the hooks of the diagonals orientated downwardly, the girder can be slid with a single manipulation against the longitudinal bar and can be erected. The girder can then be moved only as far as the perpendicular. Further turning of the girder in the opposite direction beyond the perpendicular is not possible because of the arrangement of the bottom flange, a feature which has already been mentioned. The girder is then retained in the perpendicular position by means of the previously described retaining clip which is hooked on to the top flange as well as on to the next longitudinal bar of the mat. The same procedure is adopted for the remaining girders in the sense that the two girders on the other side of the mat will be situated in mirror-image configuration relative to the girders which have already been placed. The top mat can then be fitted. This is done by the relevent longitudinal bars being situated immediately in front of the top flanges of the two girders which face the operators. The relevant longitudinal bars can be engaged with the hook-shaped extensions of the girder diagonals with only one manipulation. The retaining clips are then engaged in the stated manner.

FIG. 4 shows the use of the novel reinforcement for an individual slab. The girder part in this embodiment is only connected to the reinforcing mat 8b, embedded in the slab-shaped concrete component 14, in the above-described manner, using the bottom flange 2.

To this end it is advantageous to combine two diagonal struts into a binder 3a.

The invention will now be explained with regard to the formwork for producing double-skinned ceiling and wall slabs of concrete, by reference to an embodiment which discloses further features. FIGS. 5 to 17 show in diagrammatic form the individual components of the formwork according to the invention and the corresponding means of assembling such formwork.

FIG. 5 shows the complete formwork assembled from the top formwork frame 15 and the bottom formwork frame 16 but without concrete and without reinforcement.

In the interests of clarity the individual components are separately shown in FIGS. 6 to 9:

FIG. 6 shows the top formwork frame 15 together with the spacer feet 17a and 17b, FIG. 7 shows the formwork surfaces 18a, 18b, 18c of timber, sheet metal or some other formwork material, for example expanded metal or similar material which can also be optionally left in the finished concrete component.

FIG. 8 shows one of the retaining tubes 19 with the lateral retaining lugs 19a and 19b. This method of mounting in accordance with FIG. 8 is proposed as an exemplified embodiment.

FIG. 9 shows the bottom formwork frame 16.

FIG. 10 shows the top formwork frame 15 together with the inserted formwork surfaces 18a, 18b and 18c. The retaining tubes 19 with the lateral retaining lugs 20a and 20b in the assembled state including reinforcement, comprising a proposed top surface reinforcement 21a and a bottom reinforcement 21b as well as the intermediate webs 22a and 22b, are shown. The top formwork frame 15 and the bottom formwork frame 16 in FIG. 10 are placed in readiness one above the other to receive green concrete but it is immaterial whether the green concrete for the top formwork frame 15 is placed before or after the formwork frames are placed upon each other.

FIG. 11 shows the entire formwork system according to the invention comprising the top formwork frame 15 and the bottom formwork frame 16 including the concrete which has been placed for the top and bottom concrete skins 23a and 23b.

FIG. 12 shows the finished double-skinned concrete slab which is exposed by appropriate stripping. Where possible stripping is performed by removing or leaving the formwork surfaces 18a, 18b and 18c (see also FIG. 11), lifting the top formwork frame 15 and lifting out the completed double-skinned concrete slab from the bottom formwork frame 16.

FIG. 13 shows another application possibility in which auxiliary frame parts 24a and 24b are inserted to produce a narrower concrete element. The position of such auxiliary frame parts 24a and 24b can be set as desired and corresponds to the required dimensions of the narrower concrete element. FIG. 13 therefore merely shows an optional embodiment.

FIG. 14 shows a modification with intermediate concrete webs 25a and 25b which can be integrally mounted by inserted formwork panels 26a, 26 b, 26c and 26d.

Figure 1:
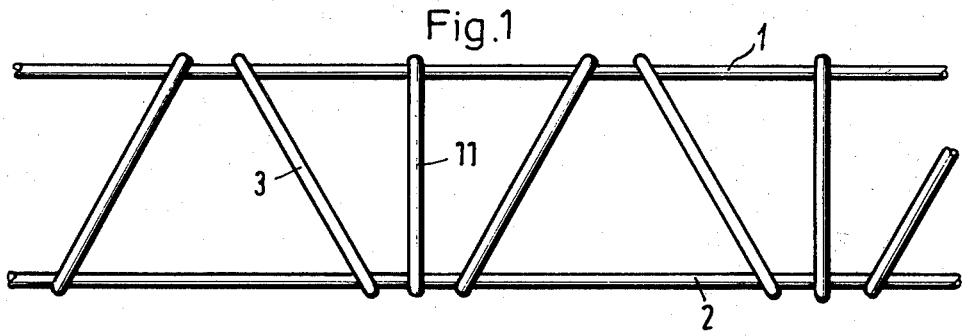
Figure 2:
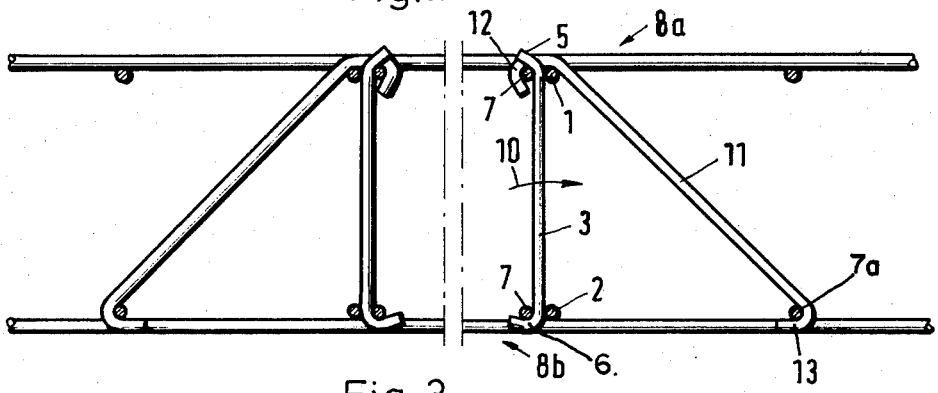
Figure 3:
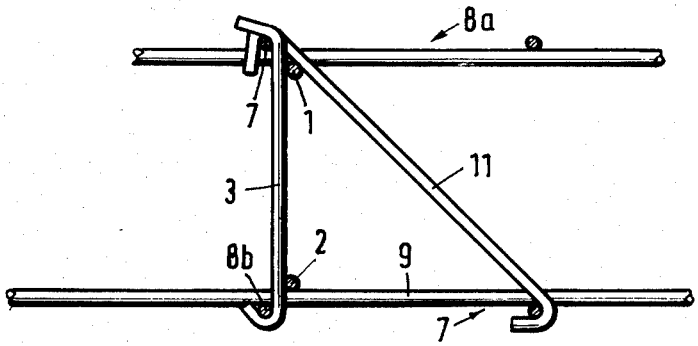
Figure 4:
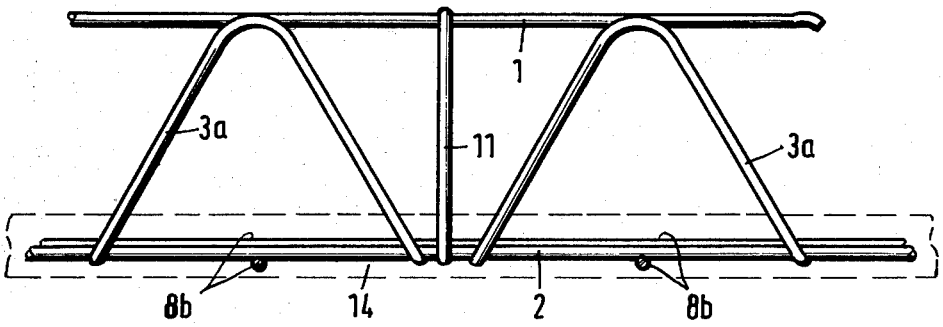
Figure 5:
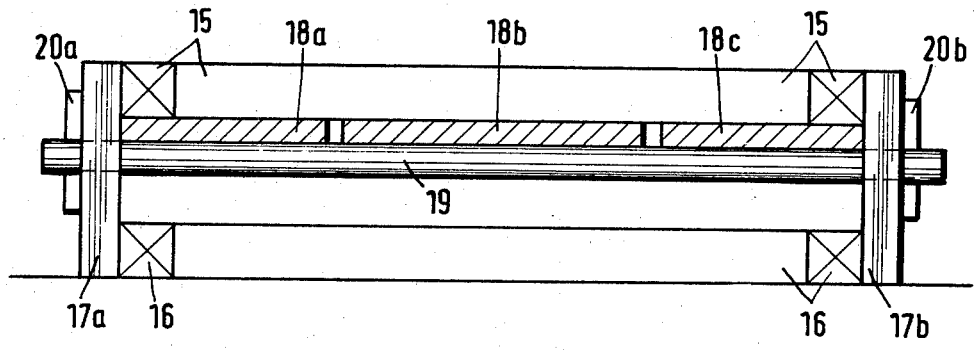
Figure 6:
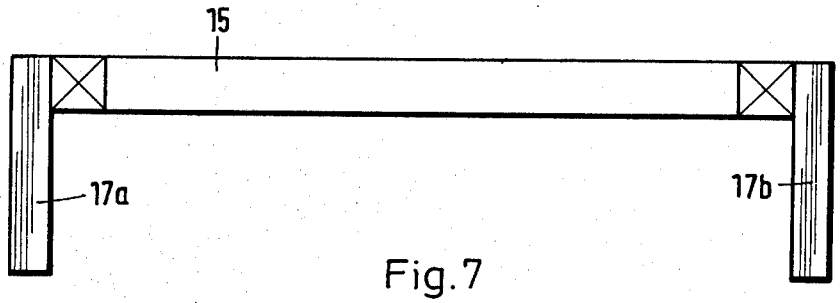
Figure 7:
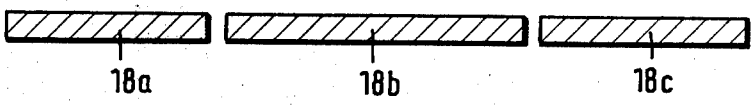
Figure 8:
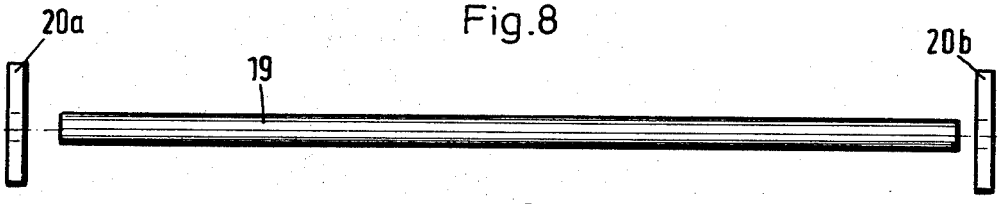
Figure 9:
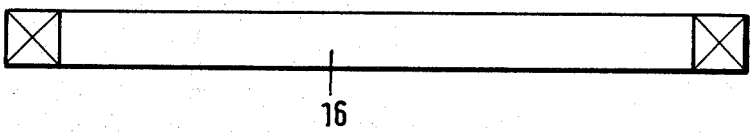
Figure 13:
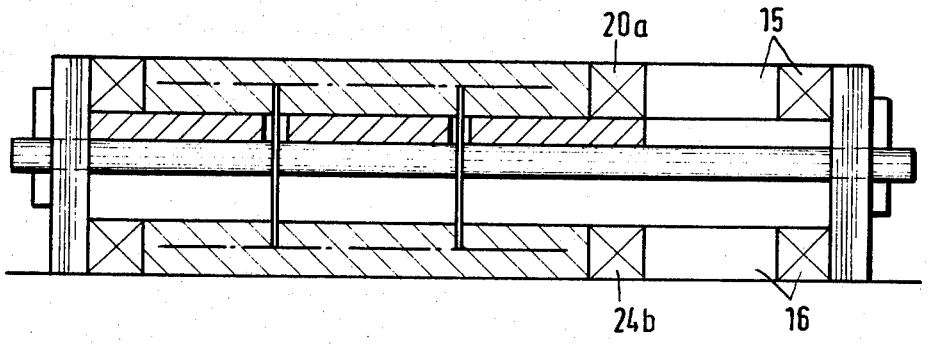
Figure 14:
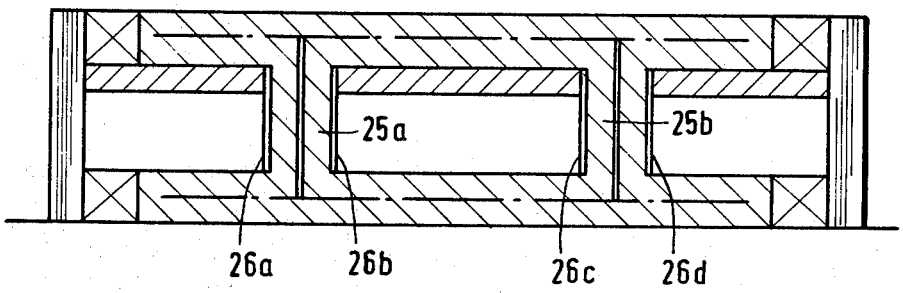
Figure 15:
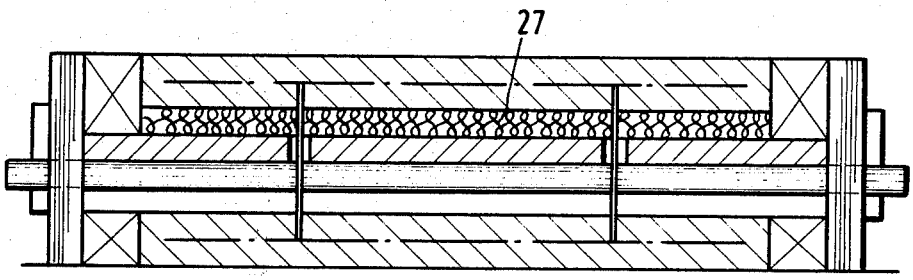
FIG. 15 shows another method of applying the formwork according to the invention, in which a thermally or otherwise insulating stratum 27 is inserted without however substantially altering or destroying the formwork or the use thereof.
Figure 16:
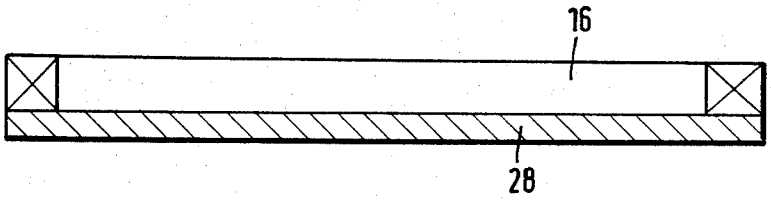
FIG. 16 shows the bottom formwork frame 16 with a formwork panel 28 optionally mounted thereunder so as to render the formwork according to the invention independent of a smooth-flat base.
Figure 17:
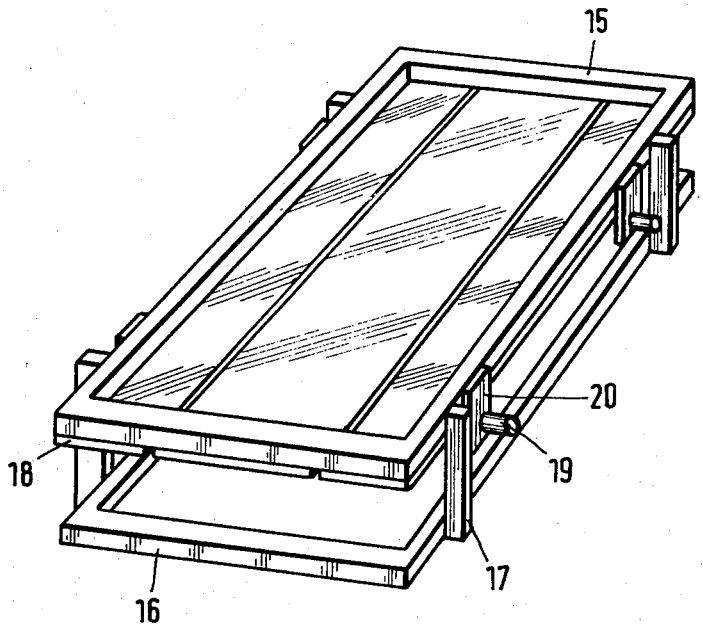
FIG. 17 is a perspective view of the formwork according to the invention with an optional arrangement of the individual components 15 to 20.

By the insertion of a profile mat or the like on the bottom concrete skin 23b and by the use of other suitable profiling means on the top of the concrete skin 23a, the formwork according to the invention permits the production of surfaces if specific sight surfaces are required. Other known steps are also possible to achieve washed concrete surfaces and other surface configurations.

As already mentioned, with the formwork according to the invention it is possible by means of chamfering, grooves or the like on the top and/or bottom formwork frames 15 or 16 to produce corresponding chamferings, grooves or other profiles in the region of the outer edge of the two concrete skins 23a and 23b of the double-skinned concrete slab and at the same time to achieve easier stripping (not shown).

The formwork according to the invention also makes it possible to produce broader or more stable double-skinned concrete slabs with more than two intermediate webs 22 or narrower double-skinned slabs with only one intermediate web 22. This merely calls for changing the formwork surfaces 18 as regards the dimensions and numbers involved.

Both concrete skins 23a and 23b cure simultaneously. Stripping is performed in the manner disclosed. All parts of the formwork according to the invention can be repeatedly re-used unless they are optionally allowed to remain in the completed double-skinned slab such as the formwork surfaces 18. The formwork according to the invention also ensures precise dimensional identity of all concrete components produced thereby.

The formwork according to the invention including all individual components consists of timber, steel, plastics or other materials and the individual parts can also be made of different materials.

Figure 18:
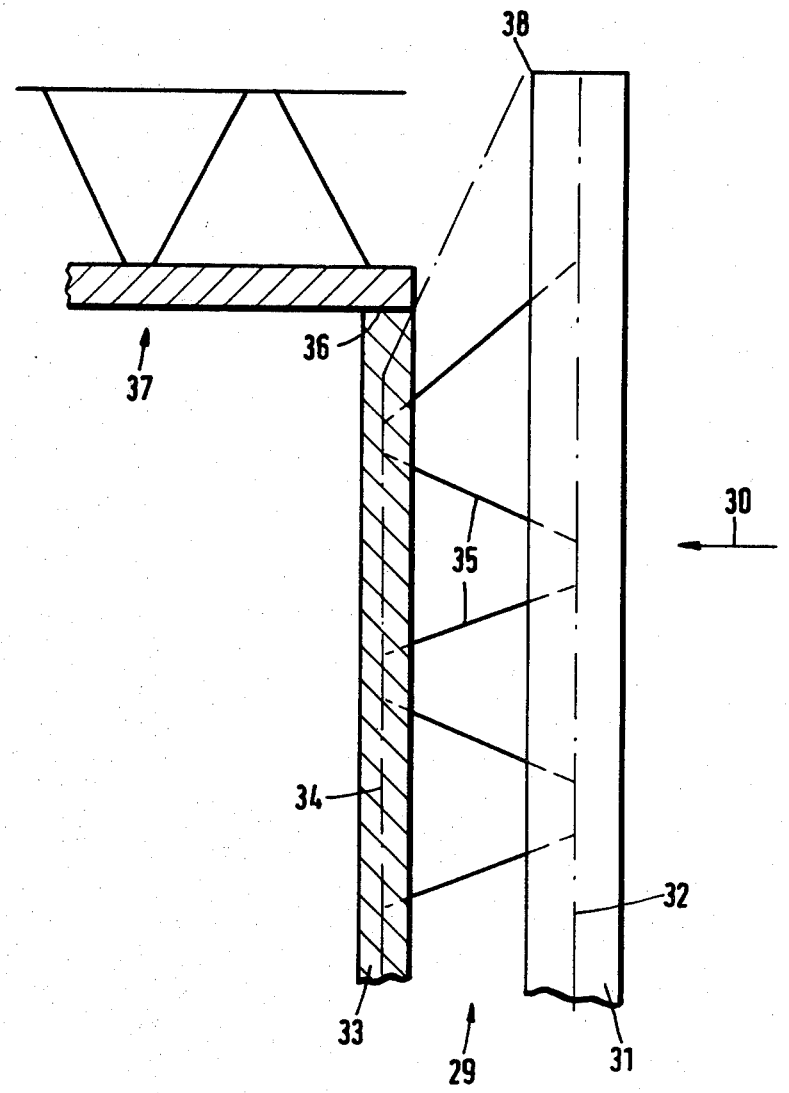

The invention will now be described with respect to the reinforcement embodiment within a double-skinned reinforced concrete slab by reference to an exemplified embodiment which discloses further important features. FIG. 18 shows in diagrammatic form a double-skinned concrete slab according to the invention when used as an external wall of a building structure in which the partially prefabricated ceiling slab is placed upon the inner skin of the concrete slab.

The soil pressure acts in the arrow direction 30 on a double-skinned concrete slab, 29. The slab 29 comprises an outer skin 31 with a reinforcement mat 32 and an inner skin 33 with a reinforcement mat 34. Diagonal binders 35 connect the mats 32 and 34 to each other and therefore connect the skins 31 and 33 to each other.

The inner skin 33 is shorter than the outer skin 32 and the inner skin is constructed to the height of the bottom edge of the ceiling while the outer skin extends to the top edge of a ceiling. Accordingly, the top horizontal edge of the inner skin 33 functions as an abutment edge. FIG. 18 indicates that a reinforced ceiling slab 37 bears upon the edge 36.

According to the invention the reinforcement mat 34 of the inner skin 33 is inwardly haunched immediately beneath the edge 36 so as to leave free a support surface of approximately 4 cm on the edge 36. The haunching therefore commences, for example approximately 40 mm, in front of the edge 36. The reinforcement 34 is extended approximately to the top inner edge 36 of the outer skin 31.

Simple concreting of the prefabricated concrete skins is thus made readily possible by these steps. At the top edge 36 the reinforcement will already have left the cross-section of the inner skin 33 of 40 mm thickness.

This also facilitates positioning in manufacture. Any reinforcement from the ceiling which projects into the wall can also be readily installed. The support surface for prefabricated ceiling elements 37 can be provided to a support depth of the conventional 4 cm without any obstruction being caused by the novel configuration of the reinforcement.

Embodiments of the invention relating to the reinforced haunched concrete slab will now be explained and further important features will be disclosed in connection with FIGS. 19 to 23.

Figure 19:
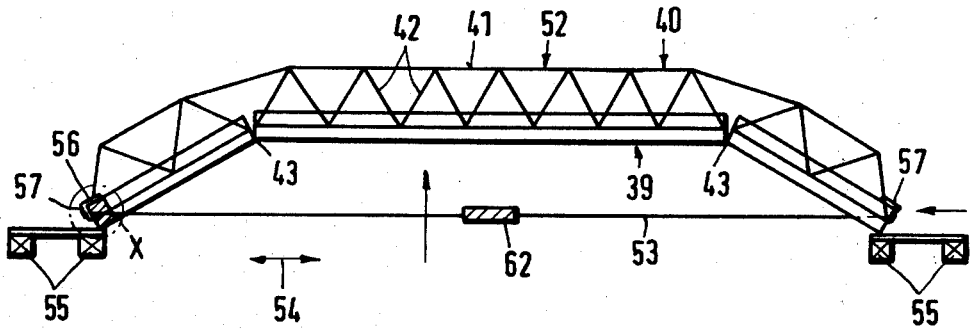
Figure 20:
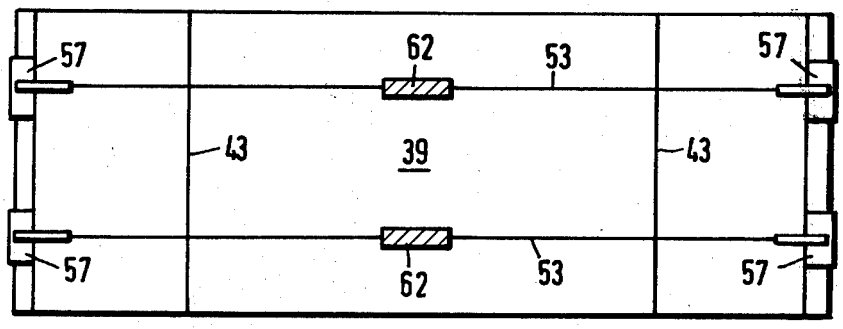
Figure 21:
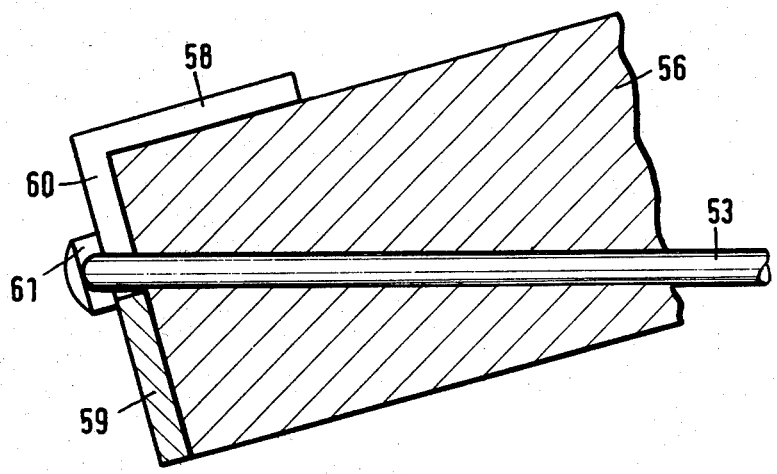
Figure 22:
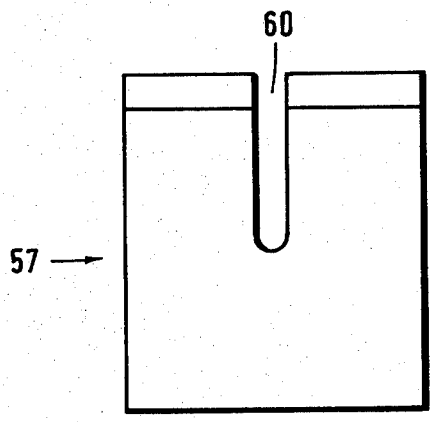
Figure 23:
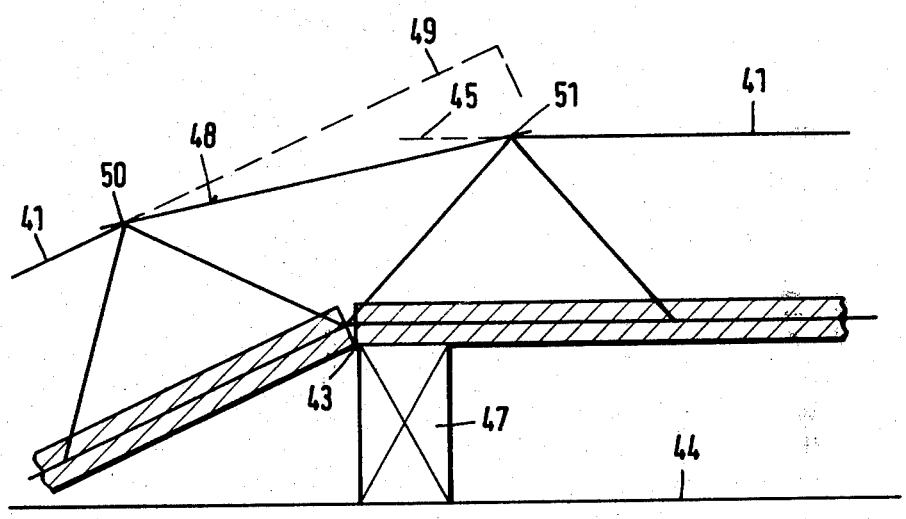

FIG. 19 shows a partially prefabricated concrete slab 39 which is reinforced by a plurality of trussed girders 40 which extend parallel with each other. Each of the trussed girders is provided with one or two bottom flange bars which extend parallel with each other and with a common top flange bar 41. The flange bars are connected to each other by means of diagonal binders 42.

In the exemplified embodiment illustrated in FIG. 19 both ends of the slab 39 are haunched at 43. This is achieved (see also FIG. 23) in that after production of the concrete slab 39 with trussed girders 40 in flat configuration, i.e. on a flat base 44, the top flange bars 41 are cut off at 45. This has already been disclosed by the above-mentioned German Offenlegungsschrift. Subsequently the main part 46 of the slab 39 is raised and placed on supports 47 the height of which is so dimensioned as to achieve the desired haunching. Thereafter a secondary bar 48 is welded to both free ends of the top flange bar 41 or trussed girders are used whose top flange bars overlap at 49. The projecting top flange bar or bars 49 are then haunched at 50 and welded to the top flange bar 41 at 51.

Conventional haunched concrete slabs must be supported over their entire length during installation so that the forces in the arrow direction 52 can be absorbed. This is obviated by the invention in that the haunched free ends of the slab 39 can be connected to each other by means of tie bars 53 which extend parallel with each other. The tie bars 53 are stressed in tension in the direction of the double arrow 54. The haunched concrete slab need then only be supported by its two ends at 55.

Both ends of the slab 39 are therefore provided at 56 with slots (see FIG. 21) through which a tie bar 53 can be inserted from below. Previously a L-shaped sectioned retaining member was placed on the ends of the slab and secured thereon in suitable manner. The retaining section bears by means of its shorter member 58 on the top of the slab 39. Its longer member 59 bears on the end edge of the slab 39. The retaining section is also provided with a slot 60 which extends through the shorter member 58 and approximately through half the longer member 59, i.e. to the height of the tie bar 53. The tie bar is inserted through the slot 56 into the slot 60 and the free end of the tie bar 53 projects from the slot 60. At that place the tie bar is anchored in suitable manner, for example by bending of its free end, by welding of a cross-bar by screw-mounting of a nut or the like. Such anchoring is indicated at 61. A correspondoing procedure is adopted for both ends of the slab 39.

The tie bars 53 can also have a turnbuckle 62 for adjusting their tension.

The slab 39 need only be haunched at one end and not at two ends as illustrated. It is however important to ensure that both ends are connected to each other through one or more tie bars 53 in the manner described hereinbefore, irrespective of whether one or two haunched places 43 are provided.

The invention of the device for aligning abutting prefabricated slabs will now be described by reference to an exemplified embodiment which discloses further important features in FIGS. 24 and 25.

Figure 24:
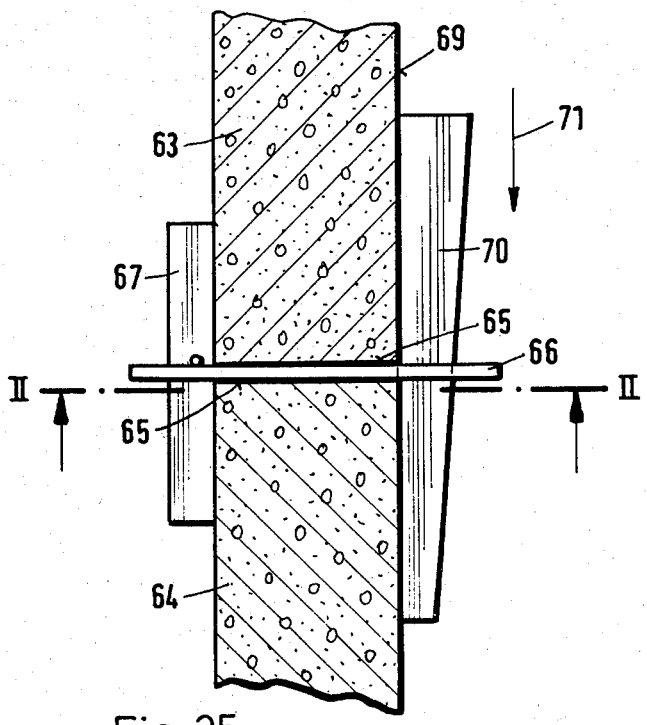
Figure 25:
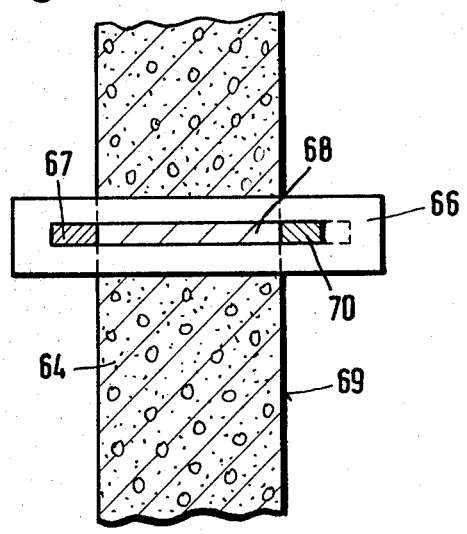

FIG. 24 discloses a first slab-shaped wall element 63 and an abutting slab-shaped wall element 64. Both wall elements can also be the outer skins of double-skinned wall elements. They abut against each other along a joint 65. The basis of the wall elements are anchored in suitable manner, for example by such wall elements being placed on suitable U-shaped concrete blocks. This is disclosed in German Offenlegungsschrift No. 2,504,286. The contents of this German Offenlegungsschrift will be used to explain the present invention to the extent to which this is necessary for an understanding thereof.

A transverse bar 66 in the form of a flat bar is inserted into the joint to align the wall elements 63 and 64 in the top region thereof. The front end of the cross-bar 66 is suitably connected to an inner longitudinal bar 67, for example by welding or by the inner longitudinal bar 67 being inserted into a longitudinal slot 68 of the transverse bar 66 at the front end thereof. This option is illustrated in FIG. 25. The longitudinal slot 68 is surrounded on all sides by the material of the transverse bar 66. The inner longitudinal bar 67 extends along the transverse direction of the joint 65.

The longitudinal slot 68 projects by a specific length beyond the external surface 69 of the wall elements 63 and 64. An outer longitudinal bar 70, constructed in wedge form, is inserted into the above-mentioned projecting part of the longitudinal slot 68 until the wall elements 63 and 64 are retained so that their surfaces are flush and their alignment is thus obtained. This can be achieved by the outer longitudinal bar 70 being drive in the arrow direction 71 into the longitudinal slot 68.

The apparatus is released in corresponding manner to which end the outer longitudinal bar 70 is initially driven out of the longitudinal slot 68 in the direction opposite to that of the arrow 71 by applying hammer blows or the like. The transverse bar 66 and the inner longitudinal bar 67 are then removed. Since the power flow produced by the outer longitudinal bar 70 is then interrupted, the inner longitudinal bar 67 can be withdrawn in simple manner from the longitudinal slot 68.

The transverse bar 66 and the longitudinal bar 67 can also be allowed to remain in the wall component, for example in cavitty walls. The transverse bar 66 is then simply cut off at the outside (at the longitudinal bar 70).

The longitudinal bar 67 can also be formed by round material and can be situated outside the longitudinal slot. The longitudinal slot 68 can also be provided on one side.

As already described in the above-mentioned German Offenlegungsschrift, the device can also be simply utilized for retaining the wall elements namely by connecting at intervals of a few meters a haunched support to the outside of the device which in turn is anchored to the floor of the relevant room.

The invention of the above-mentioned device for aligning prefabricated slab-shaped wall elements will be explained in detail hereinbelow by reference to exemplified embodiments which disclose further important features in FIGS. 26 to 35.

Figure 26:
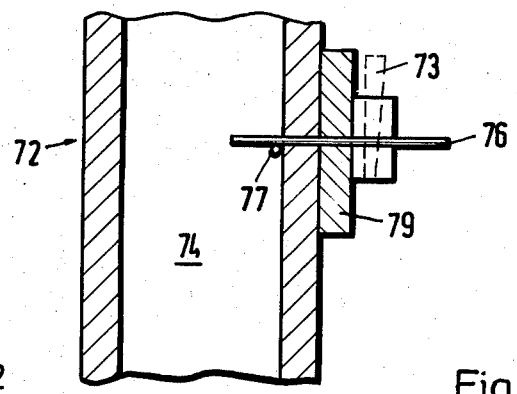
Figure 27:
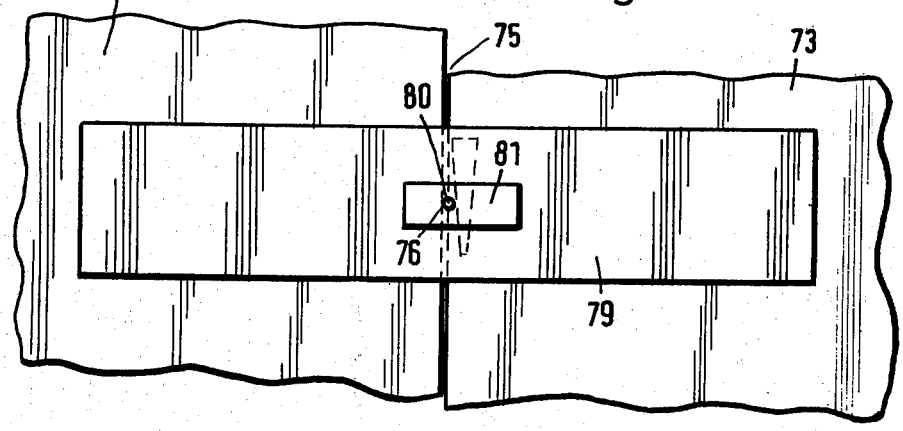
Figure 28:
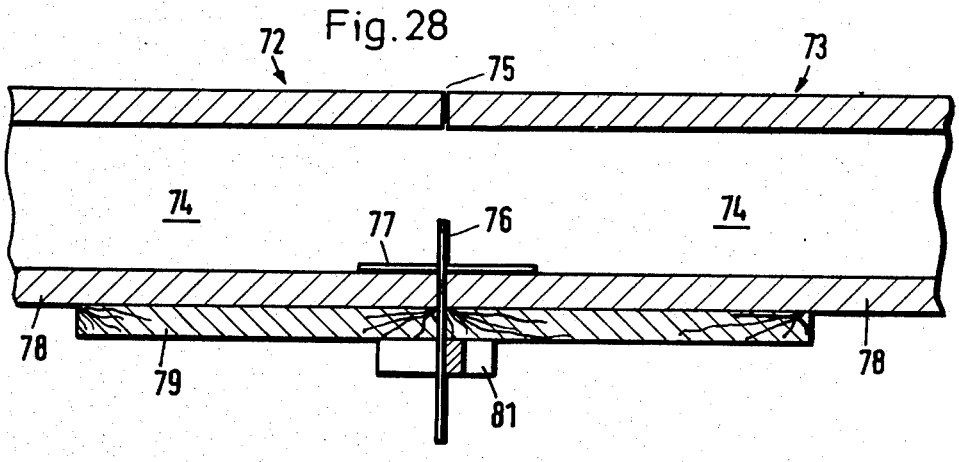
Figure 29:
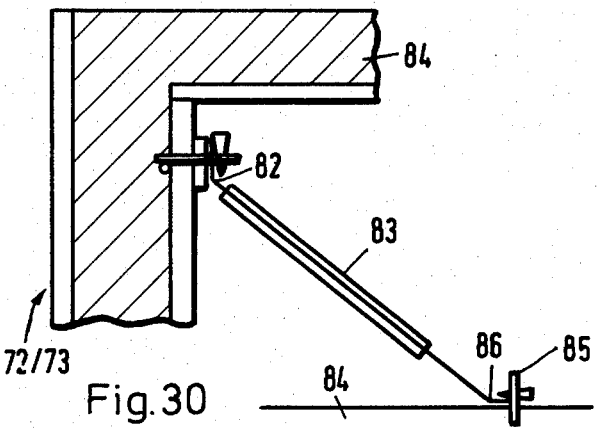
Figure 30:
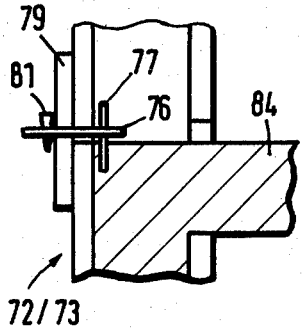

First, the installation of basement walls will be explained. The base point of basement walls is usually defined by special U-shaped concrete blocks or by one-sided abutment on the foundation or on the basement floor. The wall elements, of which FIGS. 26 to 28 show double-skinned wall elements 72 and 73 with a cavity 74, to be filled with on-site concrete as an exemplified embodiment, are retained in the joints 75 between the said wall elements. To this end a cavity corresponding to the cavity 74 or a joint construction which permits casting-in of the joints is necessary in the interior of the wall of all slab-shaped wall elements which are so used. This construction is in any case provided for reasons of statics.

The wall tops are retained in the joint 75 by means of a wire cross comprising a connecting bar 76 and a retaining bar 77 which is welded thereto and extends transversely thereto. The retaining bar 77 is situated in the hollow core of the wall and bears on both insides of the outer skins 78 of the wall elements 72 and 73.

Retention on the outside of the wall elements is obtained by a formwork board 79, for example of 60 cm length, into which a hole 80 is drilled. The drilled formwork board is slid on to the connecting bar 76 which projects from the wall. A turnbuckle 81 is fitted on said connecting bar. The turnbuckle is then tightened with a conventional stressing device and flush alignment of the surfaces of the individual wall elements is then obtained. The bars 76 and 77 can be cut from a reinforcement mat with a diameter of approximately 4 mm.

To provide horizontal retention for the entire wall a top panel 82 of a sloping support 83 must be placed at a distance of approximately 5 m on the formwork board 79 which is also provided with the conventional bore to enable it to be placed on the connecting bar 76. The turnbuckle 81 is then fitted on the vertically projecting top panel of the sloping support and is then tensioned.

Retention at the base of the longitudinally adjustable sloping support is obtained by means of a steel pin 85 which is previously inserted into the concrete of a ceiling 84 of the building structure or by means of a drilled dowel. The horizontally disposed baseplate 86 of the turnbuckle 83 is placed upon the base pin before being secured on the wall element. The base pin is then lightly bent over to provide additional retention. It is also possible to secure it with a turnbuckle. The sloping support 83 is a normal steel strut with screwthreading by means of which the precise vertical wall position can be corrected (see FIG. 29).

The long formwork boards between the sloping supports produce a flat internal wall surface. The external wall surface is thus also simultaneously adjusted and retained since it is fixedly connected to the internal wall.

To install the walls in the form of external walls, the installation base and installation top are retained in the same manner by means of the welded steel wire cross as described previously regarding the installation of basement walls.

At the base point the wire is inserted through the horizontally extending joint in the external wall surface and the formwork board is placed thereon in the vertical direction and connected by means of the turnbuckle. This fixes the bottom point. Rough alignment of the wall surface on the inside is obtained by simple wedges.

The wall top is retained on the inside as already described for the basement walls. After the permanent connection through concrete and steel is made, the steel wires are cut off (see FIG. 30).

Figure 31:
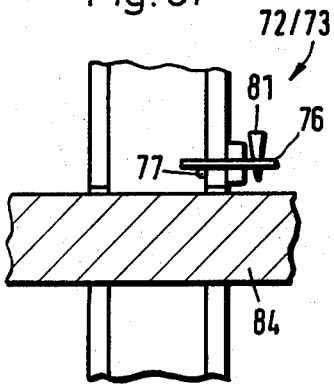

The principle of installing the walls as internal walls is exemplified in FIG. 31. Basically, the device described by reference to FIGS. 26 to 28 is also used to this end. Installing internal walls becomes particularly difficult if a plurality of wall elements are used which are usually not very broad. The wall base is prepared by means of a specially installed support surface. Angle frames 87 (see FIGS. 34 and 35), which can be of any desired length, are produced to this end. The angle frames are adjusted to the width of the wall and support cross-connector webs (flat bars) 88 at a distance of approximately 1 m.

On the sides the angle frames comprise angle iron with equal flanges, connected to each other by means of the flat bars 88. The flat bars can be slightly lower than the angle iron. The angle frames are placed on the completed concrete ceiling 89, are aligned, filled to the top edge with a suitable mortar 90 and are then smoothed off.

It is sufficient if the angle sections have a flange length of 3 cm.

By staggering individual lengths of, for example 2.0, 1.0 and 0.50 m, it is possible to prepare practically all wall supports, including those constructed in ferroconcrete. Maximum openings of 0.4 m can be tolerated since it is assumed that the width of the prefabricated wall components will be at least 50 cm. A cavity at the wall support base would not involve any risk for stability. The object of this preparation is to obviate additional levelling of the many individual elements.

After setting of the edge concrete, which absorbs the conventional tolerances of a cast in situ concrete ceiling or of a prefabricated ceiling has set, the angle frame 87 is removed and can be used for other wall supports. This operation can be performed within a few hours if a suitable mortar is used to this end.

To install the units, an unequal flange angle bar is placed on one side of the prepared concrete edge lipping and a flat bar or a simple reinforcement wire with turnbuckle on both sides of the kind used in formwork construction is inserted into the existing transverse openings formed by the transverse webs of the angle frame. During installation of the walls the angle iron forms a stop abutment and can be removed after installation. An alternative retention with drilled formwork boards and tendons is also possible.

Figure 32:
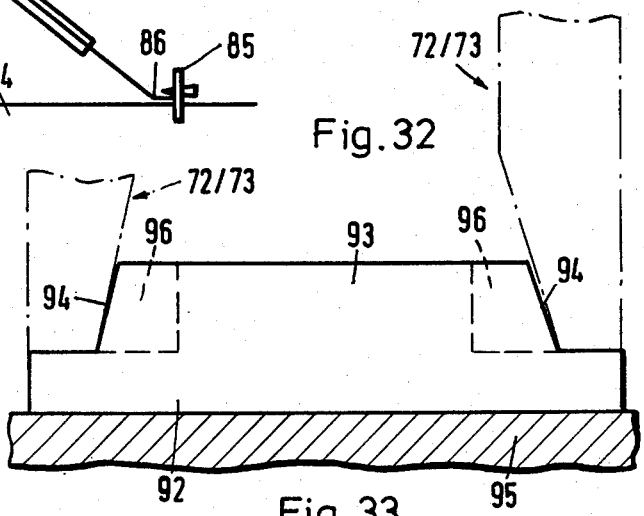
Figure 33:
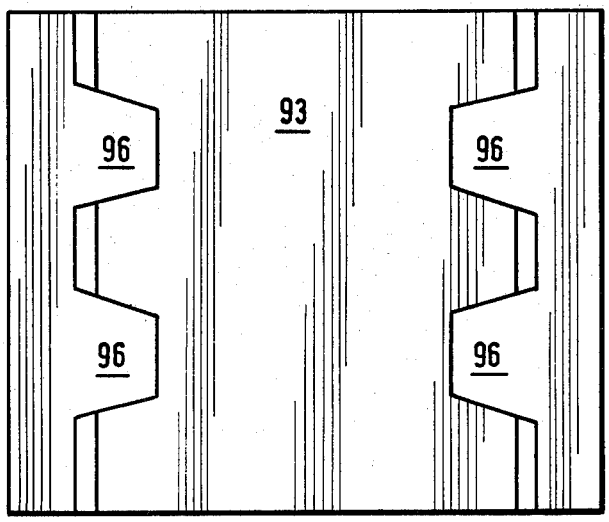
Figure 34:
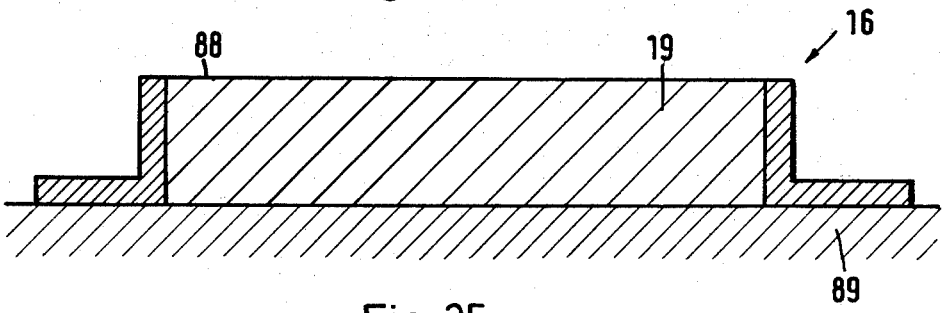
Figure 35:
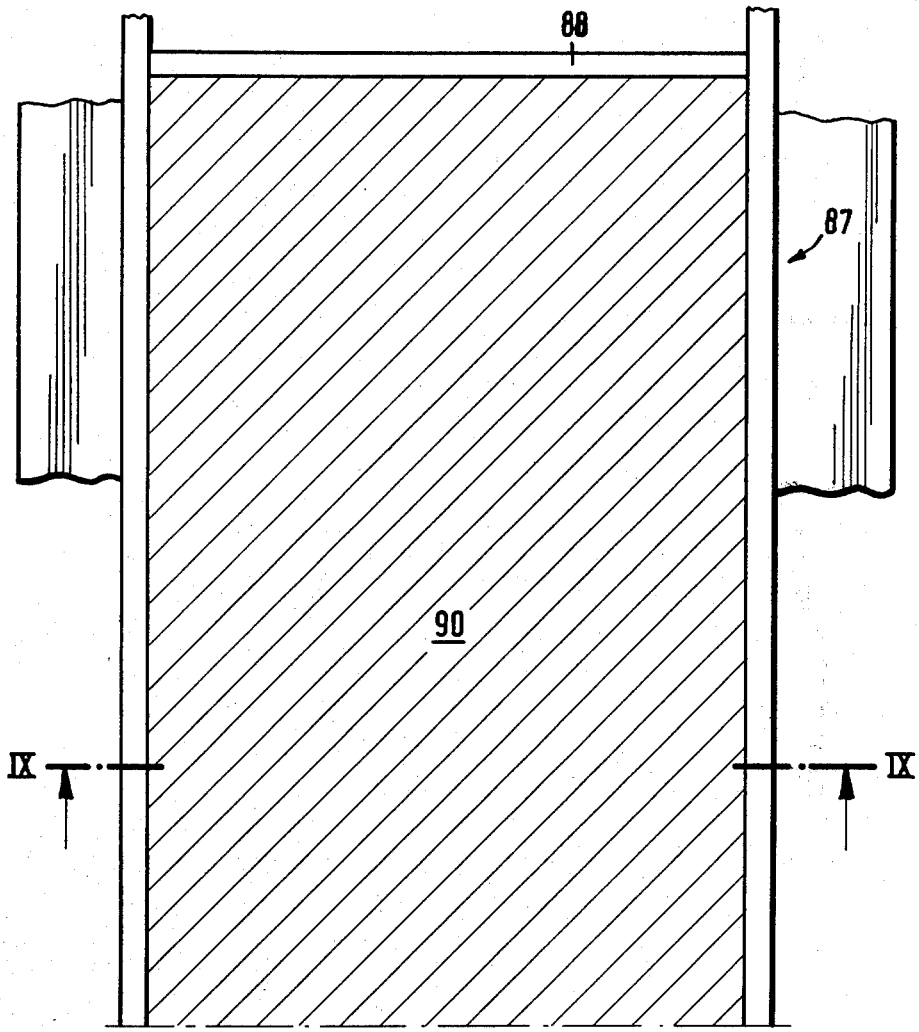

FIGS. 32 and 33 show an alternative method of installation by means of base blocks 91 for cavity walls 72 or 73. The base blocks comprise a baseplate 92 with a central raised portion 93 which has conically converging flanks 94. The internal wall elements and external wall elements can be aligned by means of such base blocks. The base blocks are previously laid in correct alignment in mortar 95. The advantage is that this obviates the need for aligning the walls at the wall base.

The base blocks can be laid with a joint of up to 15 cm width to the next block so that correct alignment can also be given to smaller parts.

The base blocks are supplied in a basic monolithic shape comprising the baseplate 92 with the trapezoidal raised portion 93 as seen in cross-section. In addition, the flanks of the raised portion 93 can be provided with concreting chambers 96 disposed at distances from each other as indicated in FIG. 32 and 33. The concreting pockets ensure that the base blocks and the wall elements form a good monolithic joint. The prefabricated components must be provided with a separate casting chamber if the advantage of the illustrated base blocks are to be utilized when installing prefabricated components of solid concrete.

Figure 37:
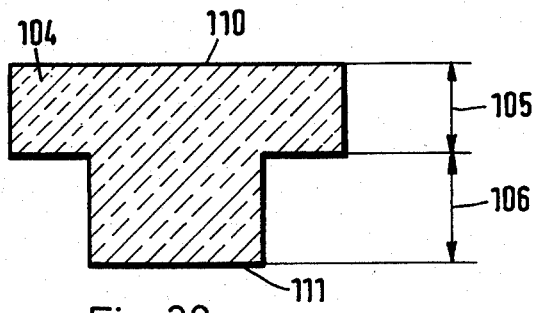
Figure 38:
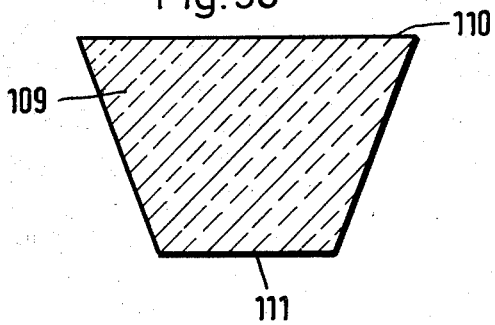

The invention of the device for the thermal insulation of joints will be explained hereinbelow by reference to exemplified embodiments which disclose further important features in FIGS. 36–38:

FIG. 37 shows in diagrammatic form a left-hand double-skinned prefabricated concrete slab comprising an outer skin 96 and an inner skin 97. Both skins are connected to each other by means of reinforcements not shown. The space 98 between the two shells 96 and 97 is filled with concrete either at the works or on site.

An insulating mat 99 bears upon the inside of the outer skin 96 for the purpose of thermal insulation.

Correspondingly, the double-skinned concrete slab illustrated on the right comprises an outer skin 100, an inner skin 101 and an insulating mat 102.

To insulate the joint 103 between the two slabs, the left-hand insulating mat 99 is sectioned in stepped form. The right-hand insulating mat 102 is identically profiled in mirror-image configuration, the axis of symmetry being formed by the joint 103. This produces a space into which a profiled insulating bar 104 of T-section is inserted.

The illustrated profile is capable of absorbing tolerances of up to approximately 10 mm in the manufacture of the reinforcement mats in the horizontal direction without any risk. Furthermore, the plane of the thermal insulating mats is also covered in the joint, thus preventing the appearance of cold bridges and associated effects of damp.

The special feature of the proposed solution resides in the introduction of the insulating bar 104 with the two rebates on site after the prefabricated cavity walls are installed and prior to being filled with concrete.

Advantageously the insulating bar 104 consists of expanded polystyrene, glass-fibre-reinforced resin or some similar material which is sufficiently stiff to enable it to be inserted into the space and which has good insulating properties. The thermal insulating mats 99 and 102 consist of similar material.

Figure 36:
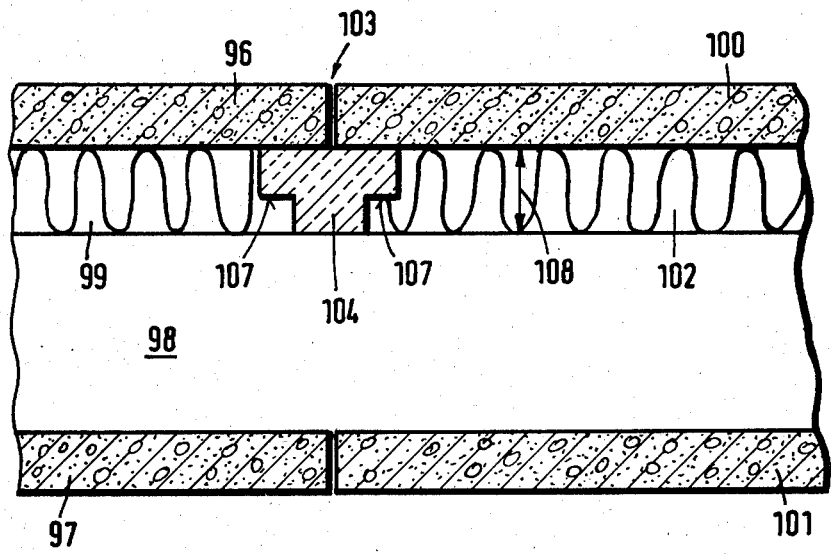

FIG. 37 shows the profile of the insulating bar 104 used in FIG. 36 to an enlarged scale. It is advantageous if the dimension 105 is slightly less than the dimension 106. For example, less by 4 mm while the corresponding step 107 in the rebate of the reinforcing mats 98 and 102 halves the dimension 108. This makes allowance in production for shrinkage of the thickness of the thermal insulating mats 99 and 102 prior to pouring the cast in situ concrete and for penetration of the concrete into the thermal insulating mats. FIGS. 38 shows another profile of an insulating bar 109 which is profiled in the form of a parallelogram. In this case the profile of the insulating bar on the outside 110 is also broader than on the inside 111. When using an insulating bar according to FIG. 38, the insulating mats 99 and 102 are correspondingly profiled along their vertical edges.

What we claim is:

1. construction system with a girder reinforcement comprising bent diagonal strut and a bottom flange for a wholly or partially prefabricated ferroconcrete wall or slab containing at least one reinforcement mat the longitudinal bars of which are partially surrounded by the bent diagonal struts of the girder member, at least the bottom flange of which bears on transversely oriented mats, and formwork for producing double-skinned concrete components, more particularly of reinforced concrete, ceiling or wall slabs comprising two concrete skins situated at a distance from each other and connected to each other by means of the reinfocement, formwork surfaces associated with a formwork frame and having openings for the intermediate webs of the reinforcement or other connecting parts and supports for the formwork surfaces of the top formwork frame and with a double-skinned reinforced concrete slab for use as a vertical building wall exposed to bending stress, namely as an external wall exposed to soil pressure, in which the inner skin is shorter than the outer skin and serves to form a bearer for a horizontal ceiling slab and the reinforcement comprises steel mats disposed in both skins and girder members which interconnect the mats and the rising reinforcement of the inner skin projects above the top endface edge thereof approximately to the height of the top edge of the outer skin together with a reinforced, haunched concrete slab as well as with apparatus for aligning abutting prefabricated construction slabs with a transverse bar on one of whose ends there is mounted an internal longitudinal bar which bears upon the surfaces of two of the construction slabs and whose other end is provided with a longitudinal slot into which a wedge is driven approximately parallel with the internal longitudinal bar and bears on the other surfaces of the construction slabs and thus aligns them, together with a device for aligning prefabricated slab-shaped wall elements and a device for the thermal insulation of joints which exist between abutting double-skinned concrete slabs in which a thermal insulating mat bears on the inside of one of the concrete skins, characterized in that as regards reinforcement there is provided a lattice girder with only one top flange and one bottom flange (1,2) and at least one of the said flange bars is supported by a strut (11) extending transversely to the plane of the girder and extending to a longitudinal bar (7*a*) of the mat (8*b*) and that as regards the formwork two formwork frames (15,16) are separated from each other and are maintained at a distance by spacer feet (17) mounted on only one of the two formwork frames (15,16) and that as regards to double-skinned reinforced concrete slab the rising reinforcement (34) of the inner skin (33) is bent towards the outer skin (31) in the region of the horizontal top support edge (36) of the inner skin (33) so that the support edge (36) remains substantially undisturbed and extends approximately to the top edge (38) of the outer skin (31) and that as regards the reinforced haunched concrete slab each of its ends is provided with a slot (56) through which extends a tie bar (53) which interconnects both ends and at its own ends is anchored on the slab by means of an L-profile piece (57) one of whose members (58) bears on the top of the slab (39) and the tie bar (53) is connected to the other member (59) of the profile piece which bears on the end edge of the slab, also that with respect to the device for aligning abutting prefabricated slabs the inner longitudinal bar (67) is inserted into a longitudinal slot (68) of the transverse bar (66) and that in the device for aligning prefabricated slab-shaped wall elements a connecting bar (76) is inserted into a joint between two abutting wall elements (72,73) and the front end of said bar has welded to it a transversely extending retaining bar (77) which bears on one of the surfaces of the wall elements, that a board (79) is provided with an open hole (80) by means of which it is slid on the rearward end of the connecting bar and bears on the other surface of the wall elements and that a turnbuckle (81), which bears on the free surface of the board, is slid on the rear end of the connecting bar and that furthermore as regards the device for the thermal insulation of the joints the edges of the thermal insulating mats (99, 102) which are adjacent to the relevant joints (103) are profiled so as to produce a continuous reception space along the longitudinal direction of the joint (103), the profile of the outside (110) of said space being broader than on the inside (111) and that a bar (104, 109) of thermally insulating material with a profile corresponding approximately to the profile of the reception space is inserted therein.

2. Construction system according to claim 1, characterized in that as regards the reinforcement the supported girder part is situated between two reinforcement mats (8*a*, 8*b*) situated at a distance from each other and the bottom flange (2) as well as the top flange (1) of said girder member bears on the transversely disposed mat bars (8).

3. Construction system according to claim 1 or 2, characterized in that as regards the reinforcement the support strut (11) is constructed as a retaining clip one end of which grips partially around the girder flange (1) and around the longitudinal mat bar (7) associated therewith and with the other end partially gripping around the longitudinal bar (7*a*) of the other half (8*b*).

4. Construction system according to claim 3, characterized in that as regards the reinforcement the retaining clip (11) serves as part of the girder diagonal and the end which surrounds the flange bar is welded thereto.

5. Construction system according to claim 1, characterized in that as regards the formwork additional auxiliary frame parts (24) are provided.

6. Construction system according to claim 5, characterized in that as regards the formwork the top and/or bottom formwork frame (15, 16) and the mountings of the formwork surfaces (18) are constructed so that additional thermal or other insulating strata can be inserted.

7. Construction system according to claim 6, characterized in that as regards the formwork additional formwork surfaces (26) are inserted.

8. Construction system according to claim 7, characterized in that as regards the formwork the top formwork frame (15) and/or the bottom formwork frame (16) is provided with chamferings, grooves or other profiles.

9. Construction system according to claim 8, characterized in that as regards the formwork the spacer feet (17) are optionally mounted on the top formwork frame (15) or the bottom formwork frame (16) or are inserted between both formwork frames (15,16) without being secured thereto, so that both formwork frames (15,16) can be set to different distances and the number and arrangement of the spacer feet (17) is not defined.

10. Construction system according to claim 9, characterized in that as regards the formwork a formwork panel (28) is mounted beneath the bottom formwork frame (16).

11. Construction system according to claim 1, characterized in that as regards the reinforced haunched concrete slab the profile member (57) is provided with a slot which extends from the free edge of the member (58) that bears on the top of the haunched slab approximately to the height of the tie bar (53).

12. Construction system according to claim 1 or 11, characterized in that as regards the haunched concrete slab the tie bar (53) is of variable length.

13. Construction system according to claim 12 in which the top flange bars of the trussed girder associated with the reinforcement of the haunched slab are cut through at the haunching point of the slab, characterized in that the free ends of the top flange bars (41) are welded to each other.

14. Construction system according to claim 13, characterized in that as regards the haunched concrete slab the free ends of the top flange bars (41) are connected to each other by means of a secondary bar (48).

15. Construction system according to claim 13, characterized in that as regards the haunched concrete slab an existing top flange bar (41), which extends beyond the separating point (45) from one side is bent and its free end is welded to another existing top flange bar (41).

16. Construction system according to claim 1, characterized in that as regards the device for aligning prefabricated slab-shaped well elements, variable-length sloping supports (83) are provided which are connected on the one hand to a ceiling (84) of the building structure and on the other hand to the connecting bar (76).

17. Construction system according to claim 1 or 16, characterized in that as regards the device for aligning prefabricated slab-shaped wall elements, angle frames (87) are provided as re-usable moulds for concreting wall bases.

18. Construction system according to claim 1 or 16, characterized in that as regards the device aligning prefabricated slab-shaped wall elements base blocks (91) are provided to function as wall bases.

19. Construction system according to claim 18, characterized in that as regards the device for aligning prefabricated slab-shaped wall elements, the base block (91) has a raised portion (93) above a baseplate (92), corresponding to the width of the wall plate thickness, and the flanks (94) of the raised portion converge conically in the upward direction.

20. Construction system according to claim 19, characterized in that as regards the device for aligning prefabricated slab-shaped wall elements, concreting pockets (96) are formed at distances from each other on the sides of the raised portion (93).

21. Construction system according to claim 1, characterized in that as regards the device for thermal insulation of the joints, the bar (104) has a T-section.

22. Construction system according to claim 21, characterized in that as regards the device for thermal insulation of the joints, the thickness (105) of the shoulder formed by the T-section and associated with the bar (104) is smaller by a small amount than the thickness of the corresponding part of the reception space.

* * * * *